United States Patent [19]

Takeuchi et al.

[11] Patent Number: 4,813,603

[45] Date of Patent: Mar. 21, 1989

[54] COLOR EXCHANGE AND CLEANING DEVICE OF MINIBELL PAINTING MACHINE

[75] Inventors: Hitoshi Takeuchi; Naoki Yamada; Hideyuki Takata; Syogo Oishi; Takenobu Yoshida; Michitaka Moritani, all of Toyota, Japan

[73] Assignees: Toyota Jidosha Kabushiki Kaisha, Toyota; Trinity Industrial Corporation, Tokyo, both of Japan

[21] Appl. No.: 84,196

[22] Filed: Aug. 12, 1987

[30] Foreign Application Priority Data

Aug. 20, 1986 [JP] Japan ..... 61-194920

[51] Int. Cl.[4] ..... B05B 5/04

[52] U.S. Cl. ..... 239/113; 239/703; 239/223

[58] Field of Search ..... 239/DIG. 22, 691, 112, 239/113, 104, 3, 7, 700, 703, 223, 224

[56] References Cited

U.S. PATENT DOCUMENTS 3,458,133 7/1969 Wiggins ..... 239/112
3,864,603 2/1975 Kozinski et al. ..... 239/691 X
4,163,523 8/1979 Vincent ..... 239/112 X
4,265,858 5/1981 Crum et al. ..... 239/112 X

*Primary Examiner*—Andres Kashnikow
*Assistant Examiner*—Kevin P. Weldon
*Attorney, Agent, or Firm*—Oblon, Fisher, Spivak, McClelland & Maier

[57] ABSTRACT

A color exchange and cleaning device of a minibell painting machine has two systems or sections, that is, a bell-side (first) color exchange and cleaning section and a counter-side (second) color exchange and cleaning section, and includes a manifold provided with a bell-side conduit and a counter-side conduit. The bell-side conduit is communicated with a trigger dump valve for the bell-side color exchange and cleaning section and a trigger valve for the counter-side color exchange and cleaning section. The counter-side conduit is connected via a connection hose with the trigger dump valve for the bell-side color exchange and cleaning section. The trigger valve for the counter-side color exchange and cleaning section is connected with a dump valve. The counter-side conduit is provided with a plurality of color valves, a low-pressure thinner valve and a low-pressure air valve. Thus, a manifold for the bell-side color exchange and cleaning section is eliminated, and the connection hose is made short.

1 Claim, 1 Drawing Sheet

COLOR EXCHANGE AND CLEANING DEVICE OF MINIBELL PAINTING MACHINE

BACKGROUND OF THE INVENTION

1. Field of the Invention

This invention relates to an improvement on the color exchange and cleaning device of a minibell painting machine which is used for painting vehicles and the like.

2. Description of the Prior Art

Electrostatic painting has been adopted in the process of painting complicated-shaped articles, such as parts of the vehicle.

At the time of practicing electrostatic painting, a high voltage is imposed on the painting machine. Thus, as this voltage exceeds a certain level, atmospheric discharge occurs from conductor elements, such as color valves, existing in a high-voltage sphere in which the painting machine is included. When there appear a lot of atmospheric discharges, the absolute value of electric current flowing when a high voltage is imposed increases with an increase in dark current, thereby tending to cause fire or explosion. To prevent such accidents, a protector incorporated in an electrostatic high voltage generator comes to operation, hence, the electrostatic high voltage frequently exhibits abnormality. When such circumstances are encountered, imposition of the high voltage is terminated to suspend the painting process of the painting machine and consequently an automatic conveyor line for articles to be painted is also stopped. If the painting process is restarted after a temporarily stoppage, color shade or color grain tends to appear on a painted surface to yeild non-conforming articles, and the productivity lowers due to a standstill of a production line.

Atmospheric discharge easily occurs from pointed portions lying in the vicinity of the painting machine with the high voltage imposed thereon, thus, it is necessary to lessen the number of such pointed portions as far as possible.

On the other hand, since a variety of color is used in painting the vehicle and the like, it is necessary each time of exchange of painting color to clean a paint transfer line and the painting machine to prevent occurrence of color mixing. Especially, in case a bell painting machine is employed, careful consideration should be taken because a bell itself is rotating at a great rate.

That is, with the bell rotating at a great rate, as a cleaning medium of high pressure is supplied to the bell and the like, a remaining paint is inconveniently scattered circumferentially due to rotation of the bell, and a large amount of cleaning medium is wasted, this being uneconomical.

Because fo the reasons described above, cleaning is customarily effected separately between two systems: the paint transfer line and the painting machine.

A conventional color exchange and cleaning device for the minibell painting machine is configured as shown in FIG. 3 and comprises two systems or sections. Specifically, a first section or a counter-side color exchange and cleaning section is located in a spot remote from a bell 16 (in a vacant spot adjacent to the automatic painting machine within a booth), and includes color valves 20, 21, 24 and 25, a counter-side manifold 19 provided with a cleaning air valve 23 and a cleaning thinner valve 22, a trigger valve 5 attached to a manifold 30 provided in the vicinity of the bell, a hose 18 connected with the trigger valve 5 and the manifold 19, and a dump valve 7 with a drain hose 8 communicated with the trigger valve 5. A second system or a bell-side color exchange and cleaning section includes a manifold 29 located in the vicinity of the bell and provided with color valves 11 and 12; a low-pressure cleaning air valve 14; and a low-pressure cleaning thinner valve 13, a trigger dump valve 9 provided on the manifold 30, a hose 28 connected with the manifold 29 and the trigger dump valve 9, a hose 4, and a feed tube 17 reaching the bell 16.

In the aforementioned conventional color exchange and cleaning device, since the counter-side color exchange and cleaning section can be cleaned by the use of air and thinner of high pressure, cleaning can be achieved in a short time even if the box is located at a rather remote position. However, in the case of the bell-side color exchange and cleaning section, the bell is an object to be cleaned, thus, it must be cleaned by the use of low-pressure air and thinner.

Therefore, where the hose 28 is long, a long time is necessary for cleaning it, and the flow resistance of the air or thinner flowing through the hose 28 becomes large when the hose is clogged to make it difficult to properly control the pressure of fluid supplied to the bell 16, thereby resulting in the problem of incomplete cleaning.

Consequently, a long time is required for cleaning the bell 16, thereby prolonging the work time of color exchange and degrading the productivity.

In addition, since the bell-side color exchange and cleaning section is located in the vicinity of the bell, the surroundings of the bell become complicated to increase the number of unstable elements causing atmospheric discharge, thereby making the safety questionable.

SUMMARY OF THE INVENTION

It is an object of the present invention to provide a color exchange and cleaning device of a minibell painting machine which is free of the foregoing defects of the prior art.

To achieve the foregoing object, the present invention eliminates a manifold from a bell-side color exchange and cleaning section and shortens a connection hose. That is, a color exchange and cleaning device of a minibell painting machine according to the present invention has two systems or sections, that is, a bell-side (first) color exchange and cleaning section and a counter-side (second) color exchange and cleaning section, and includes a manifold provided with a bell-side conduit and a counter-side conduit. The bell-side conduit is communicated with a trigger dump valve for the bell-side color exchange and cleaning section and a trigger valve for the counter-side color exchange and cleaning section. The counter-side conduit is connected via a connection hose with the trigger dump valve for the bell-side color exchange and cleaning section. The trigger valve for the counter-side color exchange and cleaning section is connected with a dump valve. The counter-side conduit is provided with a plurality of color valves, a low-pressure thinner valve and a low-pressure air valve.

Because of the foregoing configuration, the bell-side color exchange and cleaning section is reduced in dimension, hence, the pressure of a cleaning medium supplied to a bell can be regulated more reliably and the time necessary for cleaning the bell can be shortened.

Further, one manifold is eliminated from the bell-side color exchange and cleaning section, hence, the surroundings of the painting machine are straightened out and the number of unstable elements causing atmospheric discharge is lessened.

DESCRIPTION OF THE PREFERRED EMBODIMENT

An embodiment of the present invention will now be described in greater detail.

Figure 1:
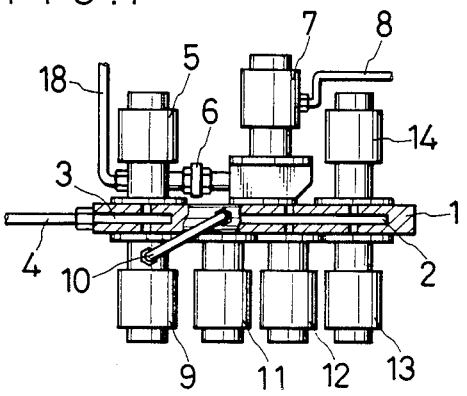
FIG. 1 is a side view, partly in cross section, showing the important portion of a color exchange and cleaning device according to the present invention.

In FIG. 1, a manifold 1 is provided with a counter-side conduit 2 and a bell-side conduit 3. To the bell-side conduit 3 are attached a trigger valve 5 and a trigger dump valve 9. The trigger valve 5 is coupled via a joint 6 with a dump valve 7, whereas the trigger dump valve 9 is connected via a hose 10 with the counter-side conduit 2. To the counter-side conduit 2 is further attached color valves 11 and 12, a low-pressure thinner valve 13, and a low-pressure air valve 14. Reference numeral 8 designates a drain hose attached to the dump valve 7, a hose connected with the bell-side conduit 3, and 18 a hose connected with the trigger valve 5. These hoses 4 and 18 are connected, respectively, with a bell-side and a counter-side color exchange and cleaning section as shown in FIG. 2.

Figure 2:
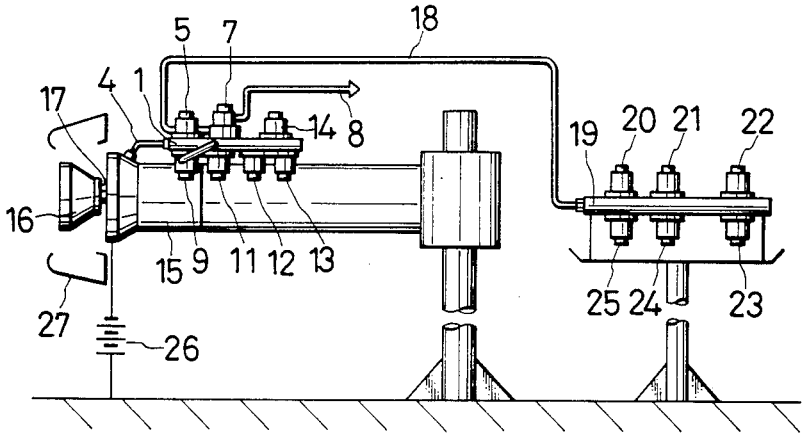
FIG. 2 is a schematic side view of a minibell painting machine incorporating the improvement of the present invention.
Figure 3:
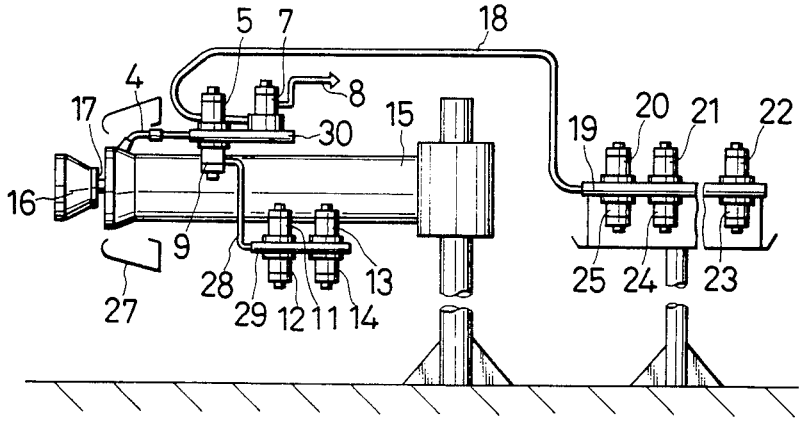
FIG.3 PRIOR ART
FIG. 3 is a schematic side view of a minibell painting machine including a conventional color exchange and cleaning device.

Specifically, in FIG. 2, the hose 4 is connected via a feed tube 17 to a bell 16, whereas the hose 18 is connected to a manifold 19. To this manifold 19 are attached color valves 20, 21, 24 and 25, a high-pressure thinner valve 22 and a high-pressure air valve 23. The manifold 19 having these valves is located in any desired spot within a booth (in a vacant spot within the booth) independent of a painting machine 15.

Because of the use of the hoses 4 and 18 connected as described above, there are formed two cleaning systems or sections: a bell-side (first) color exchange and cleaning section and counter-side (second) color exchange and cleaning section. That is, the bell-side color exchange and cleaning section has the route starting from the counter0-side conduit 2 provided with the color valves 11 and 12, low-pressure thinner valve 13, and low-pressure air valve 14; through the hose 10, trigger dump valve 9, bell-side conduit 3, hose 4, and feed tube 17; and reaching the bell 16. The counter-side color exchange and cleaning section has the route starting from the counter-side manifold 19 provided with the color valves 20, 21, 24 and 25, high-pressure thinner valve 22, and high-pressure air valve 23; through the hose 18, trigger valve 5, joint 6, and dump valve 7; and reaching the drain hose 8.

In FIG. 2, reference numeral 26 designates an electrostatic high voltage generator, and 27 a shroud.

The operation of the embodiment configured as above will now be described.

When the minibell painting machine 15 is to perform painting with a color (for example, red) supplied from the counter-side color valve 20, at first, the dump valve 7 is opened and the color valve 20 is opened to fill the path from the manifold 19 to the dump valve 7 with a paint. Thereafter, the dump valve 7 is closed. At this moment, the bell 16 is started to rotate and a high voltage is imposed on the minibell painting machine 15 by the electrostatic high voltage generator 26. As the trigger valve 5 is opened under the thus attained condition, the paint is supplied through the bell-side conduit 3, hose 4, and feed tube 17 to the bell 16, whereby automatically-conveyed articles to be painted are subjected to electrostatic painting.

Upon completion of painting or when to effect color exchange, at first, the electrostatic high voltage generator 26 is turned off, and the trigger valve 5 and the color valve 20 are closed. Then, a cleaning start command signal is delivered from a control device. In response to this command signal, at first, the high-pressure air valve 23 is opened and the dump valve 7 is also opened, as a result, the paint confined within the manifold 19, hose 18, trigger valve 5, joint 6, and dump valve 7 is pushed out and discharged through the drain hose 8 into a waste tank. Then, the high-pressure air valve 23 is closed and the high-pressure thinner valve 22 is opened, so that washing is performed by causing thinner to flow through the same path as for the air. Cleaning is repeated a desired number of times by alternate use of air and thinner, and finally the air is passed to remove thinner, whereby this process is completed.

Since the counter-side color exchange and cleaning section is cleaned by the use of the high-pressure air and thinner, the cleaning process can be completed within a short time even if the route of this section is long.

Concurrently with cleaning of the counter-side color exchange and cleaning section, the bell-side color exchange and cleaning section is also cleaned.

That is, the low-pressure air valve 14 is opened and the trigger dump valve 9 is opened, as a result, the low-pressure air passes through the box-side conduit 2, hose 10, and trigger dump valve 9, so that the paint confined within the bell-side conduit 3, hose 4, and feed tube 17 is pushed out. Since the bell 16 is rotating at a great rate (a cleaning rate), the extrusion rate of the paint must be set such that the paint thus pushed out cannot be scattered by the bell 16.

If the air pressure were too high, the paint pushed out be scattered by the bell 16 to soil the surroundings objectionably.

Next, the low-pressure air valve 14 is closed and the low-pressure thinner valve 13 is opened, so that washing is performed by causing the thinner to flow through the same path as for the air. In this way, air and thinner are alternately caused to flow a desired number of times and finally the air is passed, whereby cleaning of the bell-side color exchange and cleaning section is completed. The trigger dump valve 9 is then closed. In the foregoing process, concurrently with the cleaning start command the shroud 27 is actuated to cover the bell 16, so that the thinner for cleaning is temporarily accumulated there and then will be returned to the waste tank.

After completion of cleaning of each color exchange and cleaning section through the foregoing process, a preparation command for another color (for example, black) is delivered from the control device when it receives a signal issued by, for example, a limit switch.

In response to this command signal, the color valve 24, for example, is opened to fill the inside up to the drain hose 8 of the counter-side color exchange and cleaning section with a black paint, and then the dump valve 7 is closed. Subsequently, the trigger valve 5 is opened to bring out the paint a little into the bell 16; at this moment the preparation is complete. Painting will be started by a next painting start command.

The foregoing description is for the case of supplying the paint through the counter-side color exchange and cleaning section. Differently, in the case of supplying the paint through the bell-side color exchange and cleaning section, the counter-side color exchange and cleaning section is not used. Accordingly, the bell-side color exchange and cleaning section only is dealty with at the time of cleaning for color exchange.

When cleaning the bell-sdie color exchange and cleaning section, the discharge pressure of the cleaning medium is limited in proportion to the revolution rate of the bell 16 by means of the feed tube 17. The discharge pressure regulated by the feed tube 17 is influenced by the discharge pressure of the air or thinner supplied through the low-pressure air valve 14 or low-pressure thinner valve 13 and by the flow resistance of the path passing through the counter-side conduit 2, hose 10, trigger dump valve 9, bell-side conduit 3, and hose 4. Further, the flow resistance varies depending upon the amount of the paint confined within the path. Accordingly, the pressure applied to the feed tube 17 when that path is clogged with the paint differs largely from when not clogged.

For example, pushing out the paint confined within the path in a short time by the air pressure can be achieved by increasing the air pressure. However, the air pressure becomes excessive with a decrease in the amount of paint within the path to thereby make cleaning of the bell insufficient. Thus, to perfectly achieve cleaning of the bell a rather long time is required contrarily.

Therefore, by making the aforementioned path as short as possible to decrease the pressure difference between when the path is clogged with the paint and when not clogged, the two processes of pushing out the paint and cleaning the bell can be fulfilled.

As described hereinabove, the color exchange and cleaning device of the minibell painting machine according to the present invention includes the manifold provided with the bell-side conduit and the counter-side conduit. The bell-side conduit is equipped with the trigger valve for the counter-side color exchange and cleaning section and the trigger dump valve for the bell-side color exchange and cleaning section. The trigger valve is connected via the short connection hose with the counter-side content. The counter-side conduit is equipped with a plurality of color valves, and low-pressure air and thinner valves. Therefore, only one manifold is sufficient for the foregoing two systems, or color exchanges and cleaning sections, and the route defined within the bell-side color exchange and cleaning section can be remarkably shortened.

Accordingly, when cleaning the bell-side (first) color exchange and cleaning section, pushing out the paint confined within the path and cleaning the bell can be performed efficiently, the cleaning time can be shortened to enhance the productivity, cleaning of the bell can be achieved reliably to avoid defects, such as color mixing and color grain, and the amount of thinner used can be lessened owing to reduction of the cleaning time; these being beneficial from the industrial and practical points of view.

Further, since there is only one manifold and the surroundings of the painting machine are straightened out, unstable elements causing atmospheric discharge are lessened to thereby improve the safety of the painting machine, accordingly, the number of stoppages of the production line is decreased and the productivity is enhanced; these also being beneficial from the industrial point of view.

What is claimed is:

1. A color exchange and cleaning device of a minibell painting machine with a minibell; comprising a first color exchange and cleaning section located at a position adjacent to said painting machine, and a second color exchange and cleaning section located at a position removed from said painting machine, characterized in that said first section is composed of;

a single flat manifold provided with an elongate bell-side conduit provided on a side adjacent to said painting machine and extending in a direction away from said painting machine, and an elongate counter-side conduit substantially colinear with said bell-side conduit provided on a side of said bell-side conduit remote from said painting machine and extending in a direction away from said painting machine, a first trigger dump valve for said first section and a second trigger valve for said second section, both communicated with said bell-side conduit, a hose for connecting said counter-side conduit with said trigger dump valve, a dump valve connected with a second trigger valve, and a plurality of color valves, a low-pressure thinner valve whose pressure is lower than that of a thinner valve provided in said second section, and a low-pressure air valve whose pressure is lower than that of an air valve provided in said second section, all communicated with said bell-side conduit.

* * * * *